US009334456B2

(12) United States Patent
Sakai et al.

(10) Patent No.: US 9,334,456 B2
(45) Date of Patent: May 10, 2016

(54) ASH-FREE COAL PRODUCTION METHOD

(71) Applicant: Kabushiki Kaisha Kobe Seiko Sho (Kobe Steel, Ltd.), Hyogo (JP)

(72) Inventors: Koji Sakai, Hyogo (JP); Takahiro Shishido, Hyogo (JP); Noriyuki Okuyama, Hyogo (JP); Maki Hamaguchi, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 8 days.

(21) Appl. No.: 14/357,642

(22) PCT Filed: Dec. 7, 2012

(86) PCT No.: PCT/JP2012/081819

§ 371 (c)(1),
(2) Date: May 12, 2014

(87) PCT Pub. No.: WO2013/089039

PCT Pub. Date: Jun. 20, 2013

(65) Prior Publication Data

US 2014/0311024 A1 Oct. 23, 2014

(30) Foreign Application Priority Data

Dec. 15, 2011 (JP) ..... 2011-274724

(51) Int. Cl.
*C10L 5/04* (2006.01)
*C10L 1/32* (2006.01)

(52) U.S. Cl.
CPC .. *C10L 5/04* (2013.01); *C10L 1/322* (2013.01)

(58) Field of Classification Search
CPC ..... C10L 5/04; C10L 9/00
USPC ..... 44/620, 627
See application file for complete search history.

(56) References Cited

U.S. PATENT DOCUMENTS

| | | | | |
|---|---|---|---|---|
| 4,618,346 | A * | 10/1986 | Schapiro et al. | 44/624 |
| 7,799,100 | B2 * | 9/2010 | Harada et al. | 44/282 |
| 8,790,420 | B2 * | 7/2014 | Harada et al. | 44/282 |
| 2006/0278041 | A1 | 12/2006 | Harada et al. | |
| 2010/0300247 | A1 | 12/2010 | Harada et al. | |

FOREIGN PATENT DOCUMENTS

| | | | |
|---|---|---|---|
| JP | 2004-307714 | A | 11/2004 |
| JP | 2009-221340 | A | 10/2009 |
| JP | 2009-227718 | A | 10/2009 |

OTHER PUBLICATIONS

International Search Report; PCT/JP2012/081819; Jan. 8, 2013.
Written Opinion of the International Searching Authority; PCT/JP2012/081819; Jan. 8, 2013.

* cited by examiner

*Primary Examiner* — Ellen McAvoy
(74) *Attorney, Agent, or Firm* — Studebaker & Brackett PC

(57) ABSTRACT

Provided is a method that controls and uniformizes fluidity of ash-free coal. The method includes the steps of obtaining an ash-free coal by removing a solvent from a solution containing a coal component dissolved therein (ash-free coal obtaining step (solvent recovering unit 8)); and mixing a plurality of coals of different types or components thereof, where the coals are capable of individually giving ash-free coals having different fluidities (mixing step (see reference signs B1 to B6)). The ash-free coal obtaining step (solvent recovering unit 8) obtains the ash-free coal by removing the solvent from the solution containing components of the coals which have been mixed.

5 Claims, 2 Drawing Sheets

ASH-FREE COAL PRODUCTION METHOD

TECHNICAL FIELD

The present invention relates to a method for producing an ash-free coal.

BACKGROUND ART

There have been ash-free coals obtained by removing ash from coals. Patent Literature (PTL) 1 discloses a customary method for producing an ash-free coal. The ash-free coal production method produces the ash-free coal by mixing coal with a solvent; removing solvent-insoluble ash from a coal component dissolved in the solvent (soluble coal component) to leave a solution containing the soluble coal component in the solvent; and removing the solvent firm the soluble coal component (from the solution).

PTL 1 describes a technique for improving the settling velocity of a solvent-insoluble component by blending general coal with caking coal (e.g., claim 1 and paragraph [0008] in PTL 1).

Suitable fluidity (thermoplasticity) of an ash-free coal varies depending on the intended use thereof. The use is exemplified by coal for coke making and a fuel typically for a boiler. Fluidity control is important particularly when the ash-free coal is used as coal for coke making.

CITATION LIST

Patent Literature

PTL 1: Japanese Unexamined Patent Application Publication (JP-A) No. 2009-227718

SUMMARY OF INVENTION

Technical Problem

A possible solution to control the fluidity is blending of plural different ash-free coals having different fluidities from each other. However, if plural different ash-free coals are blended (i.e., if ash-free coals produced individually are blended) to give an ash-free coal, the resulting ash-free coal suffers flora uneven distribution of fluidity, i.e., it includes portions with high fluidity and portions with low fluidity. The ash-free coal having such unevenly distributed fluidity, particularly when used as coal for coke making, causes the coke to suffer from unevenly distributed strength.

Accordingly, an object of the present invention is to provide an ash-free coal production method that can control and uniformize the fluidity of the ash-free coal.

Solution to Problem

The present invention provides an ash-free coal production method that includes the steps of preparing a slurry by mixing coal with a solvent (slurry preparation step); extracting a component of the coal soluble in the solvent (solvent-soluble coal component) to give an extraction product by heating the slurry prepared in the slurry preparation step (extraction step); separating a solution from the extraction product extracted in the extraction step, the solution containing the solvent-soluble coal component (separation step); and obtaining an ash-free coal by removing the solvent from the solution separated in the separation step (ash-free coal obtaining step). The ash-free coal production method further includes the step of mixing a plurality of coals of different types or components thereof at a timing before the ash-free coal obtaining step, where the coals are capable of individually giving ash-free coals having different fluidities from each other. The ash-free coal obtaining step obtains the ash-free coal by removing the solvent from a solution containing components of the coals which have been mixed.

Advantageous Effects of Invention

The present invention can control and uniformize the fluidity of an ash-free coal.

DESCRIPTION OF EMBODIMENTS

Figure 1:
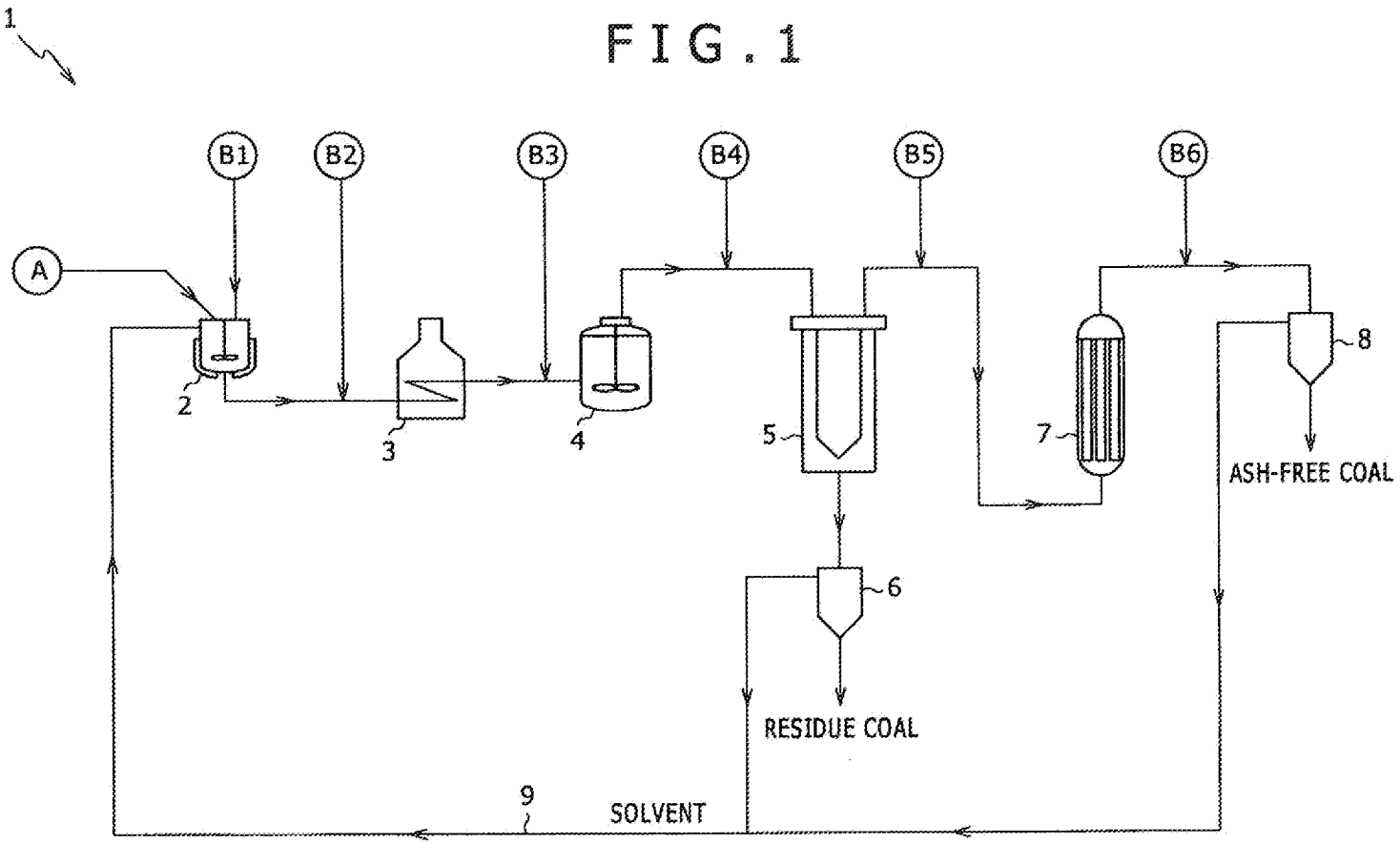
FIG. 1 is a schematic diagram of ash-free coal production equipment to carry out the ash-free coal production method.

With reference to FIG. 1, the ash-free coal production equipment 1 to carry out the ash-free coal production method, and the ash-free coal production method will be sequentially illustrated.

The ash-free coal production equipment 1 is an apparatus to produce an ash-free coal by removing ash from a material coal (hereinafter also simply referred to as "coal"). The "ash" refers to a substance that remains after something is burnt. The ash-free coal production equipment 1 includes a slurry preparation tank 2 that mixes a coal and a solvent with each other to prepare a slurry a preheater 3 connected to the slurry preparation tank 2; an extractor 4 connected via the preheater 3 to the slurry preparation tank 2; a solution separating unit 5 connected to the extractor 4; a solvent recovering unit 6 and a filter 7 respectively connected to the solution separating unit 5; and a solvent recovering unit 8 connected via the filter 7 to the solution separating unit 5. The ash-free coal production equipment 1 also includes a solvent circuit 9 that connects the solvent recovering unit 8 and the sol vent recovering unit 6 to the slimy preparation tank 2.

The ash-free coal production method is carried out with the ash-free coal production equipment 1 and produces an ash-free coal (hypercoal) by removing ash from a coal. The ash-free coal is a coal containing substantially no moisture and little ash. The ash-free coal contains ash in a content of typically 5 percent by weight or less, and preferably 3 percent by weight or less. The ash-free coal has a higher heating value (heat output), better ignitability, and better burnout quality than those of the material coal and is usable as a high-efficient fuel typically for boilers. The ash-free coal has higher fluidity (thermoplasticity) than that of the material coal and is usable as a material or part of material (opal blend) for coke for iron making use. The ash-free coal production method includes a slurry preparation step, a preheating step, an extraction step, a separation step, a filtration step, an ash-free coal obtaining step, and a recycling step in this order. The ash-free coal production method further includes a mixing step and a mixing ratio determining step upstream tom the ash-free coal obtaining step. The ash-free coal production method may further include a residue coal obtaining step downstream from the separation step.

The slurry preparation step is performed in the slurry preparation tank 2 and is the step of mixing coal with a solvent to prepare a slurry. Details of the slurry preparation step are as follows. A coal is fed from a feeder (not shown) to the slurry preparation tank 2. A solvent is fed from a solvent circuit 9 to the slurry preparation tank 2. The slurry preparation tank 2 mixes the fed coal and solvent with each other to prepare a slurry. The concentration of the coal relative to the solvent is preferably from 10 to 50 percent by weight, and more preferably from 15 to 35 percent by weight on a thy coal basis. The prepared slurry is fed from the slurry preparation tank 2 via the preheater 3 to the extractor 4.

The solvent used in the slurry preparation step is one capable of dissolving the coal therein. The solvent is preferably one having a high percentage (extraction rate) of a soluble coal component to be extracted. The solvent is exemplified by a solvent containing an aromatic compound and will be described in detail later. Specifically, the solvent is exemplified by methylnaphthalene oil and naphthalene oil, which are distillate oils of byproduct oils obtained when coal is subjected to carbonization to produce coke. The solvent preferably has such a boiling point as to provide a high extraction rate in the extraction step and a high solvent recovery rate in the ash-free coal obtaining step and has a boiling point of typically preferably front 180° C. to 300° C., and more preferably from 230° C. to 280° C.

The solvent will be illustrated in further detail below. The solvent may for example be an aromatic solvent. Such aromatic solvents include a non-hydrogen-donor solvent and a hydrogen-donor solvent.

The non-hydrogen-donor solvent is a solvent that is a coal derivative and is purified mainly from carbonization products of coal. The non-hydrogen-donor solvent contains, as principal components, bicyclic aromatic compounds. The bicyclic aromatic compounds are exemplified by naphthalene, methylnaphthalene, dimethylnaphthalene, and trimethylaphthalene. The non-hydrogen-donor solvent further contains other components such as naphthalenes, anthracenes, and fluorenes, each of which has an aliphatic side chain; and alkylbenzenes corresponding to them, except being added with biphenyl and/or a long-chain aliphatic side chain. The non-hydrogen-donor solvent is stable even under heating, has high dissolving power with respect to the coal (has excellent affinity for the coal), and exhibits a high extraction rate of the coal component. The non-hydrogen-donor solvent can be easily recovered by a process such as distillation.

A hydrogen-donor compound (including a coal-derived liquid) constituting the hydrogen-donor solvent is exemplified by 1,2,3,4-tetrahydonaphthalene. The hydrogen-donor solvent, when used as the solvent in the slurry preparation step, provides a higher yield of ash-free coal than that of the non-hydrogen-donor solvent.

The preheating step is a step that is performed in the preheater 3 and preheats the slurry to be introduced to the extractor 4. It is acceptable that the method does not include the preheating step.

The extraction step is a step that is performed in the extractor 4 and heats the slurry prepaid in the slurry preparation step (slurry preparation tank 2) to extract a coal component soluble in the solvent (hereinafter also referred to as a "solvent-soluble component"). Organic components in the coal are extracted in the extraction step. Details of the extraction step are as follows. The slurry fed to the extractor 4 is heated to and held at a predetermined temperature while being stirred with a stirrer arranged in the extractor 4. This process extracts the solvent-soluble component from the slurry. However, the extraction product contains not only the solvent-soluble component, but also ash and other components that are insoluble in the solvent (hereinafter also referred to as "solvent-insoluble components"). The extraction product is fed from the extractor 4 to the solution separating unit 5.

The slurry heating a in the extraction step is performed at such a temperature as to allow the solvent-soluble component to be dissolved in the solvent. Specifically, the slurry heating may be performed at a temperature of typically preferably from 300° C. to 420° C., and more preferably from 350° C. to 400° C.

The slurry heating (extraction) in the extraction step is prefer-ably performed for such a time as to allow the solvent-soluble component to be dissolved in the solvent sufficiently and as to extract the solvent-soluble component at a sufficiently high extraction rate. Specifically, the heating may be performed for a time of preferably from 5 to 60 minutes, and more prefer-ably from 20 to 40 minutes. When the slurry is heated (preheated) in the preheater 3, the "heating time" refers to a total heating time in the preheater 3 and in the extractor 4.

The extraction step is preferably performed in the presence of an inert gas. Of such inert gases nitrogen gas is typically preferred because of its inexpensiveness. A pressure to be applied to the slurry in the extraction step is preferably from 1.0 to 20 MPa, although it may vary depending on the temperature and the vapor pressure of the solvent to be used in the extraction.

The separation step is a step that is performed in the solution separating unit 5 and separates a solution from the extraction product extracted in the extraction step, which solution contains the solvent-soluble coal component. Details of the separation step are as follows. The solution separating unit 5 separates the fed extraction product into a solution and a solids-enriched fluid. The solution is, a solution containing the solvent and, dissolved therein, the solvent-soluble component. The solids-enriched fluid is a slurry fluid (slurry) containing ash, and other solvent-insoluble components. The solids-enriched fluid is fed from the solution separating unit 5 to the solvent recovering unit 6. The solution is fed from the solution separating unit 5 via the filter 7 to the solvent recovering unit 8. The solution separating unit 5 is exemplified by a gravitational settling tank that separates the solution typically by gravitational settling; a filtering device that separates the solution typically by filtration; and a centrifugal separator that separates the solution typically by centrifugal separation.

The residue coal obtaining step is a step that is performed in the solvent recovering unit 6 and evaporates and removes the solvent from the solids-enriched fluid to thereby yield a residue coal. The residue coal is a coal including ash and other solvent-insoluble components concentrated therein. The residue coal is usable typically as part of a coal blend for coke making. Details of the residue coal obtaining step are as follows. The solvent recovering unit 6 removes or separates the solvent from the fed solids-enriched fluid by evaporative separation to recover the solvent. The evaporative separation will be described later. The solvent recovering unit 6 thus removes the solvent from the solids-enriched fluid and yields a residue coal. The recovered solvent is fed (recycled) from the solvent recovering unit 6 via the solvent circuit 9 to the slurry preparation tank 2. It is acceptable that the method does not include the residue coal obtaining step.

The filtration step is a step that is performed in the filter 7 and filtrates of a solid contaminated in the solution separated in the separation step. It is acceptable that the method does not include the filtration step.

The ash-free coal obtaining step is a step that is performed in the solvent recovering unit 8 and removes the solvent from the solution separated in the separation step to give an ash-free coal. Details of the ash-free coal obtaining step are as follows. The solvent recovering unit 8 removes (separates) the solvent from the fed solution by evaporative separation.

The evaporative separation may be performed by a separation process such as a regular distillation process or evaporation process (e.g., spray drying). The evaporated and separated solvent is fed (recycled) from the solvent recovering unit 8 via the solvent circuit 9 to the slurry preparation tank 2. Specifically, the solvent is circulated in the ash-free coal production equipment 1 (solvent recycling step). Thus, the solvent recovering unit 8 removes the solvent from the solution to give an ash-free coal.

The ash-free coal obtaining step is the step of separating the solvent from a solution to give an ash-free coal, which solution contains components of coals mixed in the mixing step as mentioned below. In the following description, an apparatus or device in which a step is performed may be indicated as parenthesized.

Mixing Step

The mixing step is the step of mixing a plurality of coals of different types or the step of mixing components of such coals, where the coals are capable of individually giving ash-free coals having different fluidities. The fluidities will be described later. The mixing step is performed at a timing before the ash-free coal obtaining step and mixes coals or components thereof. The term "a timing before the ash-free coal obtaining step" refers to, of steps for obtaining an ash-free coal, a stage or step upstream from the ash-free coal obtaining step and does not include a step or stage in or after (downstream from) the step of obtaining a residue coal alone. Embodiments of the timing at which components of the coals are mixed are as follows.

B1: In an embodiment, the mixing step is performed at a timing before the slurry preparation step (the slurry preparation tank 2). Specifically, the material coal A and the material coal B1 are mixed with each other to give a mixture before being fed to the slurry preparation tank 2, but the mixture is fed to the slurry preparation tank 2. In another embodiment, the material coal A and the material coal B1 are separately fed to the slurry preparation tank 2 and are mixed with each other in the slurry preparation tank 2.

B2 and B3: In embodiments, the mixing step is performed at a timing after the slurry preparation step (the slurry preparation tank 2) and before the extraction step (extractor 4). In this case, the term "mixing step" refers to a "step of mixing coals".

Specifically, in an embodiment, the mixing may be performed typically by mixing a slurry containing the coal A with the coal B2 (by adding the coal B2 to the slurry containing the coal A from above).

In another embodiment, the mixing may be performed by mixing a slurry containing the coal A with a slurry containing the coal B2. More specifically, the mixing may be performed by preparing a slurry containing the coal A in a first slurry preparation step; separately preparing a slurry containing the coal B2, in a second slurry preparation step; and mixing the slurries with each other.

In another embodiment, the slurry containing the coal A may be subjected to the preheating step (preheater 3) and then mixed with the coal B3 (or with a slurry containing the coal B3).

B4: In an embodiment, the mixing step is performed at a timing after the extraction step (extractor 4) and before the separation step (solution separating unit 5). Specifically, the mixing step may be performed by mixing an extraction product containing a component of the coal A with an extraction product containing a component of the coal B4. In this case, the term "mixing step" refers to a "step of mixing components of coals". More specifically, the mixing step may be performed by extracting a first extraction product containing a component of the coal. A through a first slurry preparation step and a first extraction step; separately extracting a second extraction product containing a component of the coal B4 through a second slurry preparation step and a second extraction step; and mixing the extracts with each other.

B5 and B6: In embodiments, the mixing step is performed at a timing after the separation step (solution separating unit 5) and before the ash-free coal obtaining step (solvent recovering unit 8). Specifically, in an embodiment, a solution containing a component of the coal A is mixed with a solution containing a component of the coal B5. In another embodiment, a solution containing a component of the coal A and undergoing a first filtration step (filter 7) may be mixed with a solution containing a component of the coal B6 and undergoing a second filtration step.

Mixing Ratio Determining Step

The mixing ratio determining step is the step of determining a mixing ratio of coals or components thereof to be mixed in the mixing step. This mixing ratio is hereinafter also simply referred to as "mixing ratio". The mixing ratio determining step is performed before the individual steps (a series of production steps performed continuously). Namely, the mixing ratio is prepared in advance. The mixing ratio determining step is the step of determining the mixing ratio based on data D relating to fluidities of ash-free coals individually derived from the coals or components thereof. The data D is hereinafter also simply referred to as "data D.". The data D act as an index of fluidities of ash-free coals actually obtained respectively from coals and are exemplified by maximum fluidity MF mentioned later. The data D may also be an index that relates to the fluidities of ash-free coals individually derived from the coals and is available without actually converting the coals into ash-free coals respectively. The data D may for example be average molecular weights of coals as described in a modification mentioned later.

Next, an embodiment will be illustrated in which ash-free coals are actually obtained from coals, and, based on which, data D relating to fluidity are obtained. The mixing ratio determining step includes an individual ash-free coal obtaining substep of obtaining ash-free coals individually from coals; and a fluidity measuring substep of measuring the fluidities of the ash-free coals obtained from the individual ash-free coal obtaining substep.

The individual ash-free coal obtaining substep is a substep of obtaining ash-free coals individually from the coals. Specifically, a first ash-free coal (defined as an "ash-free coal $\alpha$") is obtained from a single (single kind) first coal (defined as the coal A). Separately, a second ash-free coal (defined as an "ash-free coal $\beta$") is obtained from a single second coal (defined as the coal B). The individual ash-free coal obtaining substep may be performed with an apparatus similar to or identical to the ash-free coal production equipment 1. The individual ash-free coal obtaining substep may also be performed with an apparatus that can be operate under similar conditions to those of the ash-free coal production equipment 1, but has a simpler structure as a scaledown of the ash free coal production equipment 1.

Figure 2:
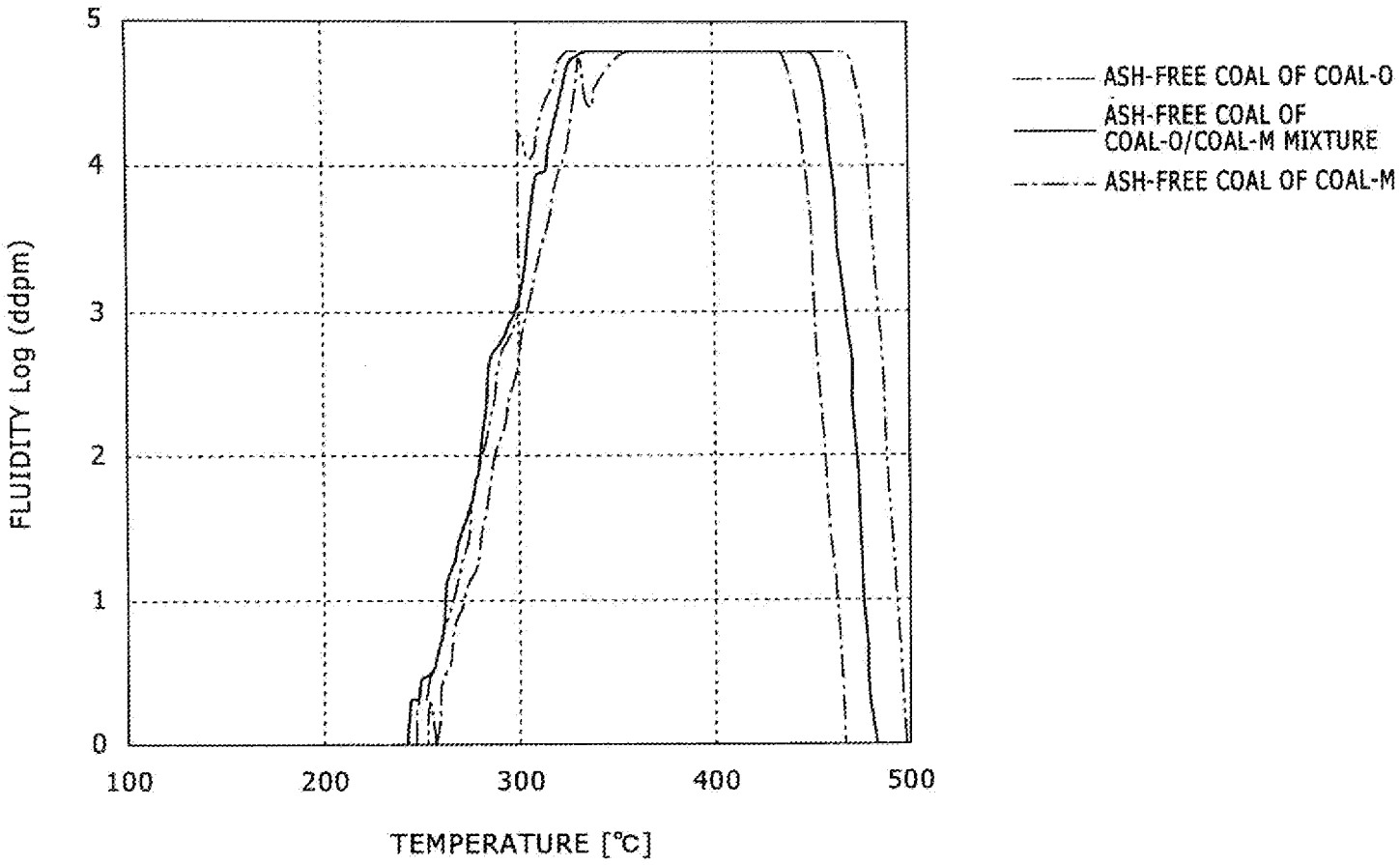
FIG. 2 is a graph illustrating how the fluidity of an ash-free coal varies depending on the temperature.

The fluidity measuring substep measures fluidities respectively of the ash-free coals $\alpha$ and $\beta$ obtained from the individual ash-free coal obtaining substep. The fluidity measurement is performed by the method using a Gieseler plastometer as prescribed in Japanese Industrial Standard (JIS) M 8801. Specifically, fluidity measuring substep determines how the fluidity varies depending on the temperature on each of the ash-free coals $\alpha$ and $\beta$. Exemplary determination results are indicated in FIG. 2 and Table 1 below. The fluidity is expressed in unit of ddpm (dial division per minute)

and indicates thermoplasticity of a sample. The fluidity measurement typically gives a maximum fluidity MF. The maximum fluidity MF, when exceeding the determination limit, may be estimated from the initial softening temperature and the solidification temperature. The terms "initial softening temperature", "solidification temperature", "fluidity", and "maximum fluidity" are as defined in JIS M 8801.

In the embodiment, the mixing ratio determining step determines the mixing ratio of components of the coals A and B based on the fluidities (e.g., maximum fluidities MFs of the ash-free coals α and β, respectively) determined in the fluidity measuring substep. The mixing ratio determining step determines the mixing ratio so as to give an ash-free coal (ash-free coal γ) having a target fluidity, which ash-free coal γ is produced by mixing components of the coals A and B with each other. Typically, the step determines the mixing ratio so as to give an ash-free coal γ having a predetermined fluidity between the fluidity of the ash-free coal α and that of the ash-free coal β.

Conditions for Plural Different Coals to be Mixed

Next, conditions for the coals to be mixed in the mixing step will be described. The coals are selected so as to give a sufficient difference in fluidity between the ash fine coal α or β and the ash-free coal γ. The ash-free coals α and β have only to be ash-free coals that can be obtained from the coals A and B as a Ingle coal respectively, and there is no need of actually obtaining them (except in "Effect 2" as mentioned later).

Details of the conditions for the roads are as follows. The ash-free coals α and β obtained from the coals A and B, respectively, differ from each other in data D on fluidity (e.g., maximum fluidity MF). In a preferred embodiment, the ash-free coals α and β respectively obtained from the coals A and B have a difference (absolute value of the difference) in maximum fluidity Log MF of 1.0 (Log (ddpm)) or more. The term "maximum fluidity Log MF" refers to the logarithm of the maximum fluidity MF. The logarithm is to the base 10. Typically, the ash-free coals may have a maximum fluidity Log MF of from 4.0 to 110 (Log (ddpm)); whereas the ash-free coal β may have a maximum fluidity Log MF of from 110 to 20.0 (Log (ddpm)).

Specifically, the coals are exemplified by combinations (1) to (3) as follows: (1) A combination of low-fluidity Coal-M (inexpensive general coal) and high-fluidity Coal-O (expensive coal for coke making). Coal-O and Coal-M will be illustrated in detail later. (2) A combination of lignite that gives, as a single coal, an ash-free coal having high fluidity and bituminous coal that gives, as a single coal, an ash-free coal having low fluidity. The bituminous coal has an extraction rate (ash-free coal recovery rate) relatively higher than those of other coals. The lignite is an inexpensive low-quality coal (3) A combination of general coals that give, each as a single coal, ash-free coals having different fluidities from each other. In addition to above combinations, various combinations for coals are possible. Instead of the above-mentioned material coals, various material coals such as subbituminous coal (inexpensive low-quality coal) can be used.

EXAMPLES

An ash-free coal was produced by mixing Coal-O and Coal-M with each other. Coal-O is a coal for coke making; whereas Coal-M is a general coal fir use typically in power generation or in boilers. Coal-O and Coal-M are both "bituminous coal" and are classified as grade B or C in the prescription of JIS M 1002. Coal-O by itself is a heavy caking coal exhibiting excellent fluidity. Coal-O, when used as a single material coal, gives an ash-free coal exhibiting excellent fluidity. Coal-O has a moisture content of 2.0 percent by weight and an ash content of 9.4 percent by weight Coal-M by itself is a non-caking coal exhibiting little fluidity and is unusable as a coal for coke making. Coal-M, when used as a single material coal, gives an ash-free coal exhibiting certain fluidity, but lower than that of the ash-free coal obtained from Coal-O as a single material coal. Coal-M has a moisture content of 1.9 percent by weight and an ash content of 12.9 percent by weight.

The fluidity was determined on three ash-free coals as follows:

"Coal-O ash-free coal"; ash-free coal produced from Coal-O as a single material coal;

"Coal-M ash-free coal"; ash-free coal produced from Coal-M as a single material coal; and "Coal-O-added Coal-M ash-free coal": ash-free coal produced by mixing Coal-M and Coal-O in a mixing ratio of the former to the latter of 90 percent by mass to 10 percent by mass.

TABLE 1

| | Initial softening temperature [° C.] | Maximum plastic range [° C.] | Solidification temperature [° C.] | Maximum fluidity log MF [log (ddpm)] |
|---|---|---|---|---|
| Coal-O ash-free coal | 232 | 330 to 466 | 499 | 11.8 |
| Coal-M ash-free coal | 247 | 353 to 434 | 472 | 9.5 |
| Coal-O added Coal-M ash-free coal | 237 | 340 to 448 | 486 | 10.1 |

The fluidity measurement results of the individual ash-free coals are indicated in Table 1. How the fluidity varies depending on the temperature on the individual ash-free coals is indicated as a graph in FIG. 2. "Coal-O-added Coal-M ash-free coal" exhibited fluidity more excellent than that of "Coal-M ash-free coal". "Coal-O-added Coal-M ash-free coal" had a maximum fluidity MF as an intermediate between those of "Coal-M ash-free coal" and "Coal-O ash-free coal".

Effects

Next, advantageous effects of the ash-free coal production method will be illustrated with reference to FIG. 1.

Effect 1

The ash-free coal production method includes the slurry preparation step (slurry preparation tank 2) of mixing coal with a solvent to give a slurry; the extraction step (extractor 4) of heating the slurry prepared in the slurry preparation step to extract a solvent-soluble coal component; the separation step (solution separating unit 5) of separating a solution from the extraction product extracted in the extraction step; and the ash-free coal obtaining step (solvent recovering unit 8) of removing the solvent from the solution separated in the separation step to give an ash-free coal.

The ash-free coal production method further includes the mixing step (see reference signs B1 to B6) of mixing coals or components thereof with each other, where the coals are capable of individually giving ash-free coals having different fluidities from each other. The ash-free coal obtaining step (solvent recovering unit 8) is the step of separating or removing the solvent from the solution containing mixed components of coals and thereby obtaining an ash-free coal.

At the stage of the ash-free coal obtaining step (solvent recovering unit 8), components of coals are uniformly mixed in a solution (liquid), where the coals are capable of individually giving ash-free coals having different fluidities from each other. This enables control and uniformization of the fluidity of the resulting ash-free coal.

Details of the Effect are as Follows.

Fluidity Control: The coals or components thereof are mixed in the mixing step, where the coals are capable of individually giving ash-free coals having different fluidities from each other. The mixing ratio of the coals or components thereof to be mixed determines the ratio among organic components contained in the ash-free coal. The ratio among organic components in turn determines the fluidity of the ash-free coal. Accordingly, the ash-free coal fluidity can be controlled according to the mixing ratio of the coals or components thereof. This can provide an ash-free coal having desired fluidity according to the intended use. The fluidity of the ash-free coal, when controlled, less changes (less varies) when other material coals are employed to form the ash-free coal.

Fluidity Uniformization: Assume that ash-free coals (solids) are produced from coals, and the produced plural different ash-free coals are mixed with each other. The mixed ash-free coal often suffers from uneven distribution of fluidity, namely, often includes portions with high fluidity and portions with low fluidity. Such an ash-free coal having unevenly distributed fluidity, if used as a coal for coke making, causes the coke to include portions with high strength and portions with low strength (to have unevenly distributed strength). In contrast, when components of coals are mixed at a process or step upstream from the ash-free coal obtaining step, the components of the coals are uniformly mixed in a solution (liquid) at the ash-free coal obtaining step. This allows the ash-free coal to have an uniformized fluidity and to less suffer from the disadvantages of unevenly distributed fluidity.

Effect 2

In an embodiment, the ash-free coal production method further includes the mixing ratio determining step of preliminarily determining the mixing ratio of the coals or components thereof to be mixed in the mixing step. The mixing ratio determining step is the step of determining the mixing ratio based on data on different fluidities, where the different fluidities are of ash-free coals individually derived from coals or components thereof.

The mixing ratio determining step determines the mixing ratio preliminarily (before the respective steps), and this contributes to more reliable control of the ash-free coal fluidity.

Effect 3

In an embodiment, the mixing ratio determining step includes the individual ash-free coal obtaining substep of obtaining ash-free coals individually from the coals; and the fluidity measuring substep of respectively measuring fluidities of the ash-free coals obtained from the individual ash-free coal obtaining substep. In this embodiment, the mixing ratio determining step determines the mixing ratio based on the fluidities determined in the fluidity measuring substep.

The configuration enables further more reliable control of the ash-free coal fluidity.

Effect 6

In an embodiment, the ash-free coals individually obtained from the coals have a difference in maximum fluidity Log MF of 1.0 (Log (ddpm)) or more.

If the ash-free coals have an excessively small difference in maximum fluidity Log MF, an ash-free coal obtained by mixing coals and an ash-free coal obtained without mixing coals have substantially no (or little) difference in fluidity from each other. In this case, the mixing of coals becomes meaningless. In contrast, when the ash-free coals have a difference in maximum fluidity Log MF satisfying the condition, the mixing of the coals reliably gives an ash-free coal having fluidity different from that of an ash-free coal obtained without mixing coals.

Modification

The mixing ratio determining step is the step of determining the mixing ratio based on data D relating to the fluidities of ash-free coals individually derived from coals, as described above. The data D may also be data obtained without actually converting the coals into ash-free coals, as described above. Specifically, in an embodiment (modification), the data D may also be average molecular weights M of coals A and B, respectively. This will be further described below.

In the modification, the mixing ratio determining step includes the substep of measuring average molecular weights M of coals A and B, respectively (molecular weight measuring substep). In the modification, the mixing ratio determining step determines the mixing ratio of the coals A and B based on the average molecular weights M measured in the molecular weight measuring substep.

Specifically, there is correlation between the average molecular weight M of a single material coal and the fluidity of an ash-free coal obtained from the single coal. More specifically, the plastic range and the maximum fluidity MF increase with a decreasing average molecular weight (with an increasing proportion of low-molecular-weight components). The term "plastic range" refers to the difference between the initial softening temperature and the solidification temperature. In contrast, the plastic range and the maximum fluidity MF decrease with an increasing average molecular weight (with an increasing proportion of high-molecular weight components).

Conditions for Plural Different Coals to be Mixed

Conditions for the coals to be mixed in the mixing step are as follows. The coals A and B have average molecular weights M differing from each other. The coals A and B preferably have a difference (absolute value of difference) in average molecular weight of 30 or more.

The difference in average molecular weight M may be set so as to satisfy the condition in maximum fluidity Log MF as described above. The coals may satisfy the condition for the difference in maximum fluidity Log MF as a result of satisfying the condition for the difference in average molecular weight M, the coals may satisfy only one of the condition for the difference in maximum fluidity Log MF and the condition for the difference in average molecular weight.

Effect 4

Next, the effect of ash-free coal production method according to the modification will be described. In the modification, the mixing ratio determining step includes the molecular weight measuring substep of respectively measuring average molecular weights of coals. The mixing ratio determining step in the modification determines the mixing ratio based on the average molecular weights measured in the molecular weight measuring substep.

Accordingly, the data Don fluidities of ash-free coals individually derived from the coats can be obtained without actually producing ash-free coals individually from the coals (without undergoing the individual ash-free coal obtaining substep).

Effect 5

In an embodiment, the coals have a difference in average molecular weight M of 30 or more.

If the coals have an excessively small difference in average molecular weight, an ash-free coal obtained by mixing components of the coals and an ash-free coal obtained without mixing components of the coals have substantially no (or little) difference in fluidity from each other. In this case, the mixing of components of coals becomes meaningless. In contrast, when the ash-free coals have a difference in average molecular weight M satisfying the condition, the mixing of (components of) the coals reliably gives an ash-free coal having fluidity different from that of an ash-free coal obtained without mixing coals.

Other Modifications

The mixing ratio determining step determines the mixing ratio based on the data D on fluidities of ash-free coals individually derived from coals, as is described above. In the embodiment and modification as described above, the maximum fluidity MF and average molecular weight M are respectively employed as the data D. The data D, however, may also be other data, as long as having relationship with fluidities of ash-free coals individually derived from the coals. Specifically, the data D may also be data typically of fluidity at a certain temperature, solidification temperature, initial softening temperature, or plastic range. The data D may also be a value calculated from a combination of two or more data such as maximum fluidity MF, average molecular weight M, fluidity at a certain temperature, solidification temperature, initial softening temperature, and plastic range.

The embodiments take the ash-free coal produced by mixing two different coals as an example. The ash-free coal, however, may also be produced by mixing three or more different opals. In this case, the three or more different coals may have a difference in maximum fluidity log MF and/or a difference in average molecular weight so that the difference between, of the three or more coals, one having a maximum value and one having a minimum value satisfies the condition.

REFERENCE SIGNS LIST

1 ash-free coal production equipment
2 slurry preparation tank
4 extractor
5 solution separating unit
7 solvent recovering unit

The invention claimed is:

1. A method for producing an ash-free coal, the method comprising the steps of:

preparing a slurry by mixing coal with a solvent;

extracting a component of the coal soluble in the solvent to give an extraction product by heating the slurry prepared in the slurry preparation step;

separating a solution containing the solvent-soluble coal component from the extraction product extracted in the extraction step;

obtaining an ash-free coal by removing the solvent from the solution separated in the separation step, wherein:

the method further comprises the step of:

determining a mixing ratio of the coals or components thereof to be mixed, wherein the mixing ratio determining step determines the mixing ratio based on data relating to different fluidities of ash-free coals individually derived from the coals or components thereof; and mixing a plurality of coals of different types or components thereof based on the mixing ratio and at a timing before the ash-free coal obtaining step, the coals capable of individually giving ash-free coals having different fluidities from each other; and the ash-free coal obtaining step obtains the ash-free coal by removing the solvent from a solution containing components of the coals which have been mixed.

2. The ash-free coal production method according to claim 1, wherein:

the mixing ratio determining step comprises the substeps of:

obtaining ash-free coals individually from the coals; and measuring fluidities of the ash-free coals respectively obtained from the individual ash-free coal obtaining substep; and the mixing ratio determining step determines the mixing ratio based on the fluidities determined in the fluidity measuring substep.

3. The ash-free coal production method according to claim 1, wherein:

the mixing ratio determining step comprises the substep of measuring average molecular weights of the coals respectively; and the mixing ratio determining step determines the mixing ratio based on the average molecular weights measured in the molecular weight measuring substep.

4. The ash-free coal production method according to claim 3, wherein the coals have a difference in average molecular weight of 30 or more.

5. The ash-free coal production method according to claim 1, wherein the ash-free coals obtained individually from the coals have a difference in maximum fluidity of 1.0 (Log (ddpm)) or more.

* * * * *